United States Patent [19]

Hammacher

[11] 4,333,569

[45] Jun. 8, 1982

[54] CARRYING HANDLE FOR DETACHABLE CONTAINERS AND CONTAINERS INCLUDING SUCH HANDLE

[76] Inventor: Margaret F. Hammacher, 1293 Elizabeth Dr., Hamilton, Ohio 45013

[21] Appl. No.: 173,432

[22] Filed: Jul. 29, 1980

[51] Int. Cl.[3] ..... B65D 75/56; B65D 85/62; B65D 5/46

[52] U.S. Cl. ..... 206/431; 206/602; 206/460; 229/52 A; 229/52 B

[58] Field of Search ..... 206/431, 602, 428, 460; 229/52 B, 52 A

[56] References Cited

U.S. PATENT DOCUMENTS

| | | | |
|---|---|---|---|
| 2,634,041 | 4/1953 | Burnett | 206/602 |
| 2,750,095 | 6/1956 | Alden . | |
| 2,846,063 | 8/1958 | Fahrenbach . | |
| 3,056,138 | 10/1962 | Flynn | 229/52 A |
| 3,221,876 | 12/1965 | Currie . | |
| 3,924,797 | 12/1975 | Furbeck . | |

OTHER PUBLICATIONS

Advertisement of Sealright-Oswego Falls Corp., etc. for "Sealking Model 300" (undated).

*Primary Examiner*—William T. Dixson, Jr.

*Attorney, Agent, or Firm*—Sandler & Greenblum

[57] ABSTRACT

A milk container has a support and pouring handle adapted to detachably connect the container to adjacent and similar milk containers. The container is a conventional gable top container and includes a handle assembly attached to the top portion of the gable top such that one end of the handle assembly extends outwardly beyond the side walls and gable top of the container. The handle portion can be integrally formed as part of the container blank or can be separately formed and attached to the top portion of a conventional gable top container by adhesive and/or staples. The handle is positioned on the container at the end of the gable top opposite from the end of the gable top which includes the pouring spout for the container. One face of the handle is covered with adhesive such that when adjacent similar containers are positioned so that these adhesive covered faces come into contact with one another, the two handles will become attached. The adhesive used is preferably relatively strong in shear and weak in tension such that the containers can be carried without fear of separation yet can be pulled apart easily when desired. After separation, the separated handles on each container can be used for pouring or carrying an individual container.

12 Claims, 5 Drawing Figures

CARRYING HANDLE FOR DETACHABLE CONTAINERS AND CONTAINERS INCLUDING SUCH HANDLE

BACKGROUND OF THE INVENTION

1. Field of the Invention

The invention generally relates to containers having handles, and more specifically relates to containers having handles which can be detachably connected to similar containers such that the handles serve as carrying handles for the individual containers as well as support handles for pouring.

2. Discussion of Prior Art

Various containers have been utilized in order to carry a plurality of containers. All of these configurations, however, are disadvantageous in one or more respects. Where a handle is provided to connect two or more adjacent containers, it is not readily detachable so that each container can be separately stored and used. In those configurations where the handle is detachable, it is destroyed upon detachment so that it is not reuseable and does not function as a carrying or pouring handle for the separated containers. Furthermore, known handles for detachably carrying more than one containers are not formed integrally with the container blank.

SUMMARY OF THE INVENTION

Accordingly, it is a general object of the invention to overcome the above and other disadvantages by providing a new and improved handle for detachably connecting a plurality of milk containers.

Another object of the present invention is to provide a new and improved handle for detachably connecting a plurality of containers which can securely connect gable top milk containers.

A further object of the present invention is to provide a new and improved handle for detachably unitizing a plurality of containers.

An additional object of the present invention is to provide a new and improved handle for detachably connecting a plurality of containers which, upon separation of the attached containers is sufficiently strong to serve as a handle for holding each of the individual container when pouring them or carrying them.

Yet another object of the present invention is to provide a new and improved handle for detachably connecting a plurality of containers which can be formed integrally with an individual container blank.

A more particular object of the present invention is to provide a new and improved handle for detachably connecting a plurality of containers which extends beyond and is offset from individual containers to facilitate pouring from each container after they are separated.

Still another object of the present invention is provide a new and improved handle for detachably connecting a plurality of containers which has two portions, each of which includes one face coated with a relatively high shear, low tensile strength adhesive for detachably joining the two containers.

A further object of the present invention is to provide a new and improved handle for detachably connecting a plurality of containers which can either be fabricated separately and attached to conventional gable top containers or formed integrally new container blanks.

A still further object of the present invention is to provide a new and improved handle for detachably connecting a plurality of containers which is used to reduce the manufacturing steps required to produce a unitized container combination.

A yet further object of the present invention is provide a new and improved handle for detachably connecting a plurality of containers which does not require staples, wire fasteners or other similar fastening elements to join the containers together, thereby maintaining sanitary conditions.

Upon further study of the specification and appended claims, further objects, features and advantages of the present invention will become fully apparent to those skilled in the art to which this invention pertains.

Briefly, the present invention is provided for in one aspect thereof by a milk container adapted to facilitate pouring and carrying. The container includes a bottom wall, a plurality of side walls foldably connected to and extending upwardly from the bottom wall; a gable top closure foldably connected to and extending upwardly from the side walls and a handle assembly connected to and extending from the top closure. The top closure includes slanting roof panels, first and second ends, and a pour spout at one end. The handle assembly has a first end connected to the closure and a second end extending beyond the closure and one of the side walls.

The present invention is provided for in a second aspect thereof by a blank for a gable top container. The blank has first, second, third and fourth foldably connected side walls, bottom flaps, roof panels and primary closure panels. The bottom flaps and roof panels are foldably connected to the bottoms and tops of the side walls, respectively. The primary closure panels are foldably connected to the roof panels. First and second secondary closure panels are foldably connected to two of the primary closure panels. A handle is attached to one of the secondary closure panels and comprises a first side wall connected to and extending transversely from the closure panel, a top handle wall extending from and generally transverse to the first side wall, a second side wall extending from and generally transverse to the top handle wall and a bottom wall extending from and generally transverse to the second side wall. The bottom handle wall is connected to one end of the secondary closure panel and is separated from one of the primary closure panels by a space.

In a third aspect, the present invention is provided for by a pair of detachably connected containers having a separable handle. Each container has a bottom wall, a plurality of side walls extending upwardly from the bottom wall, a gable top closure extending upwardly from the side walls and a handle assembly connected to and extending upwardly from the closure. The closure has first and second ends with a pour spout at the first end. The handle has two ends and faces, and one face is covered by an adhesive. The adhesive faces abut one another when the containers are connected.

BRIEF DESCRIPTION OF THE DRAWINGS

The above and other objects, features and advantages of the present invention will be more fully apparent to those of ordinary skill in the art to which this invention pertains from the following details and description, when considered in connection with the accompanying drawings, in which like reference characters designate like or corresponding parts throughout the several views, and wherein.

DETAILED DESCRIPTION OF THE DRAWINGS

Figure 1:
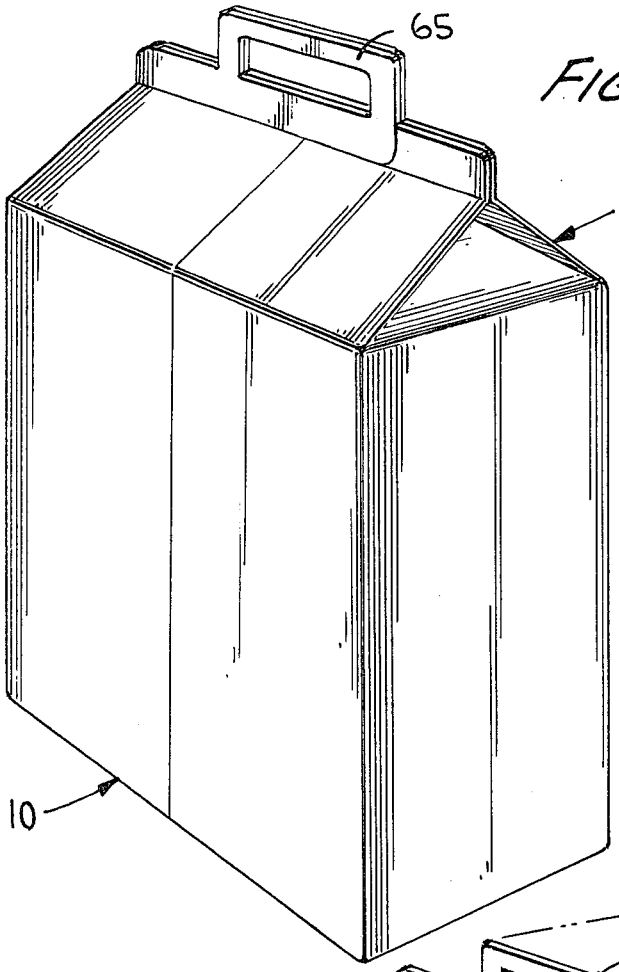
FIG. 1 is a perspective view of two connected containers formed in accordance with the present invention.
Figure 2:
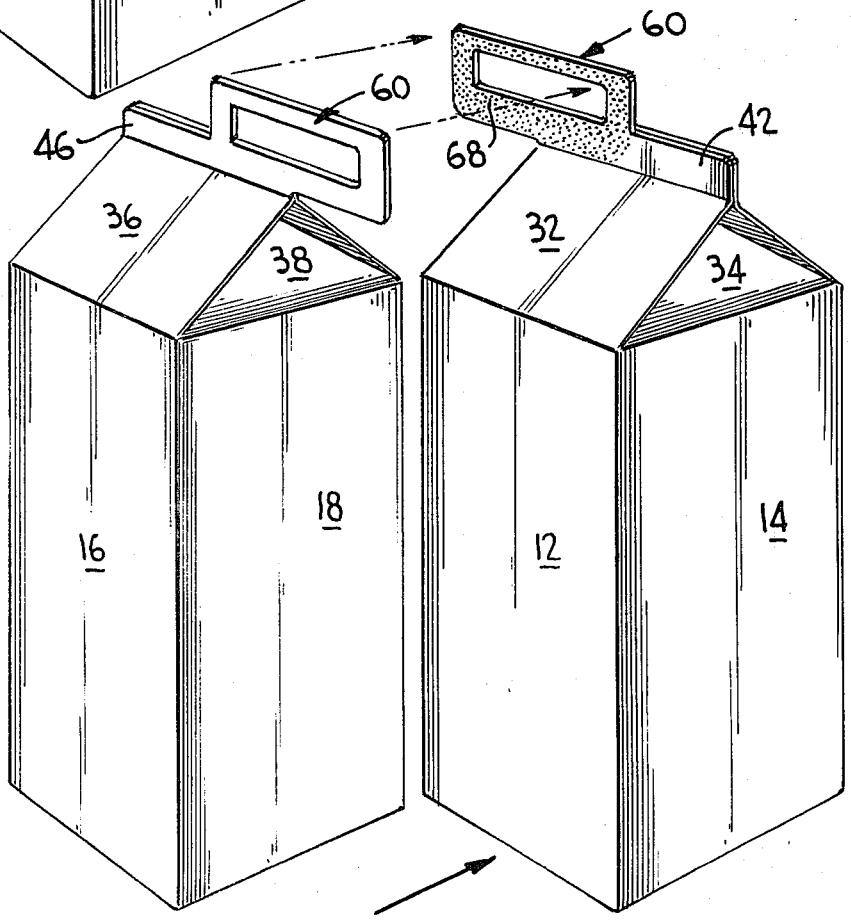
FIG. 2 is a perspective view of the two containers of FIG. 1 prior to attachment.

FIG. 1 illustrates in detail the combination of two gable top milk containers 10 which are attached. When attached, the handle portions of each container are united to form a unitary handle 65. The containers, which are illustrated in greater detail in FIG. 2, are identical. This enables only one container blank to be manufactured and folded to form a desired container yet allows such a container to be turned or rotated so that it can be attached to a second, identical container. As illustrated in FIG. 2, each container 10 comprises first, second, third and fourth side walls 12, 14, 16 and 18, respectively. Each container also includes a gable top closure comprising first, second, third, and fourth roof panels 32, 34, 36, and 38, respectively, each of which is connected to a respective one of the first through fourth side walls. Positioned atop the gable closure is a handle assembly. The assembly includes handle 60 and first and third primary closure panels 42 and 46 extending upwardly from said gable top in generally vertical fashion. One face of the handle is coated with adhesive, as illustrated in FIG. 2. This "inner" face of the handle comes into contact with the inner face of a second handle, as illustrated by the arrows in the upper portion of FIG. 2, to form the unitary handle 65 illustrated in FIG. 1. The handle and/or handle assembly two ends, the second end extending beyond the gable top closure and one side wall of the container so that when two containers are placed adjacent to one another each such extending portion will come into contact with an opposed portion of the handle on the other container, the opposed portion generally positioned above the gable top. The end of the handle assembly extends beyond the side of the container which is opposite from that side of the container which is generally opened to form the pour spout, i.e. sidewall 14 having roof panel 44 which is openable to form a pour spout in conventional fashion. By positioning the handle of each container in this manner, when the containers are separated their handles will not interfere with the opening of the container to form a pour spout and the handles can be utilized to assist in pouring liquid from the container. The first end of the handle is attached to the upper portion of the gable closure, and is shown attached between the ends of this closure.

The adhesive used to carry the containers is preferably one which is relatively strong in shear and weak in tension. These characteristics are desirable to enable two containers which have been detachably connected by adhering the interface of their respective handles to be carried together without separation due to the weight of the container and its contents. It is also important, however, that the adhesive be relatively weak in tensile strength so that it is easy to pull the containers apart by exerting a minimum amount of force to detach the two handles and therefore the containers from each other. Once the containers have been separated, the separated handles remain attached to the individual cartons to carry each individual container or to serve as a handle to facilitate pouring of the contents through the pour spout at the side of each container opposite from the side over which the handle extends.

Figure 3:
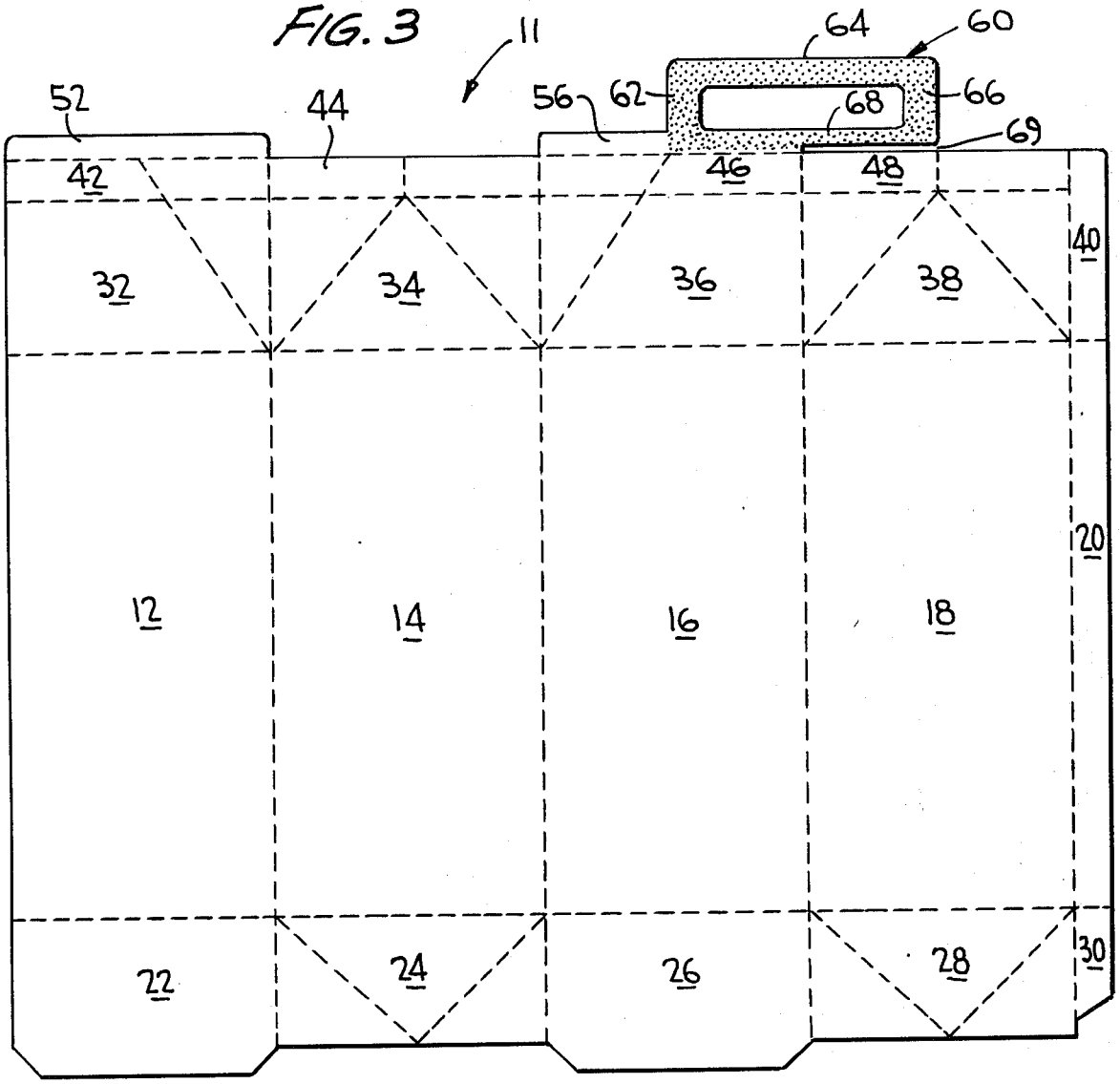
FIG. 3 is a plan view of the blank used to form the containers shown in FIGS. 1 and 2.

The handle can either be formed integrally with the container blank or can be formed separately and attached to conventional gable top containers so that a manufacturer will not have to modify existing container manufacturing equipment. Blank 11 is formed in accordance with the present invention and comprises a modified gable top container having a unitary handle for detachable connection to an identical or similar container, as illustrated in FIG. 3. The blank includes first, second, third and fourth side wall panels 12, 14, 16 and 18. A fifth sidewall panel comprises manufacturer's glue panel 20, which is conventionally used to hold the four panels together in the form of a tube when erected. First, second, third and fourth bottom flaps 22, 24, 26 and 28 are respectively foldably connected at the bottom of panels 12, 14, 16 and 18. These bottom flaps, in addition to bottom glue panel flap 30, are used to close the container bottom so that it will sealingly retain the liquid contents of the container.

The gable top of the container, which includes two transverse pairs of opposed slanted roof panels, includes first, second, third and fourth roof panels 32, 34, 36 and 38, respectively, which are respectively foldably connected to the tops of the four side walls 12, 14, 16 and 18. Roof panel glue flap 40 is connected to the top portion of manufacturer's glue panel 20 and also serves as part of the gable top closure.

Foldably connected to the tops of the first through fourth roof panels are first, second, third and fourth primary closure panels 42, 44, 46 and 48, respectively. When the container is closed, these panels extend upwardly in a generally vertical position from the point of intersection of roof panels 32 and 36, as illustrated in FIG. 2.

First and second secondary closure panels 52 and 56 are foldably connected to the top portions of the first and third primary closure panels 42 and 46, respectively. These secondary panels, in combination with the primary closure panels 42, 44, 46 and 48 and handle 60, form the handle assembly of the container. A portion of one face of secondary closure panel 56 is covered with adhesive to assist in connection of two identical containers formed from blanks 11.

Integrally connected to closure panel 56 is handle 60. The handle includes first side wall 62 extending upwardly from and generally transverse to a portion of panel 56 located between the ends of the panel. Top handle wall 64 extends generally transverse to first side wall 62 and generally parallel to closure panels 46, 48 and 56. Handle second side wall 66 extends generally downwardly from and transverse to top handle wall 64 and is generally parallel to first side wall 62. Bottom handle wall 68 extends from and in a direction generally transverse to the second side wall 66 and is substantially parallel to top handle wall 64. The bottom handle wall is integrally connected to one end of panel 56. The bottom handle wall 68 extends over approximately one-half of the length of handle 60 and is integrally connected to a second end of secondary closure panel 56. As illustrated in FIG. 3, the entire inner face of handle 60 is covered with the adhesive described hereinabove. A slit 69 is provided between bottom handle wall 68 and fourth primary closure panel 48. This is necessary to insure that when the carton is erected, a portion of the handle and/or handle assembly will extend beyond the gable top closure and the side of the container opposite from the pour spout, here formed by panel 34. This will insure that the handle of each container will not interfere with the opening of the pour spout and the pouring of liquid material from each container.

By using the above blank only one blank having the integral handle need be manufactured. By simply turning one of the cartons 10 formed from blank 11 around, thereby insuring that adhesive is placed on the inner faces of adjacent cartons, it is not necessary to form two separate, complementary containers in order to attach them to one another to form a unitary, multi-container arrangement. The container blanks are formed from conventional material, e.g., paperboard or coated paperboard.

Figure 4:
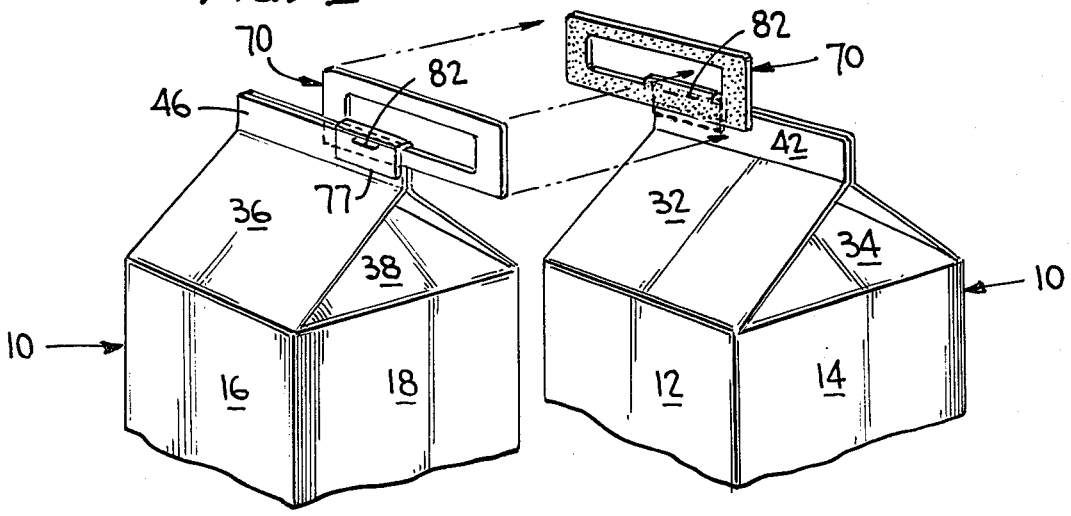
FIG. 4 is a perspective view similar to that of FIG. 2 in which handles are formed separately and then attached to conventional containers.

Alternately, conventional and existing milk containers can be modified by attaching a separate handle 70 to the top portions of these containers so that they can be detachably connected and carried as can the containers which include integral handle 60. As illustrated in FIG. 4, handle 70 is attached conventionally, e.g., by adhesive or staple 82, to the top portion of a container formed by primary closure panels 42, 44, 46 and 48. Handle 70 is attached to the outer face of first primary closure panel 42 and the inner face of handle 70 is coated with adhesive so that it can be connected to an identical handle 70 on another container 10.

Figure 5:
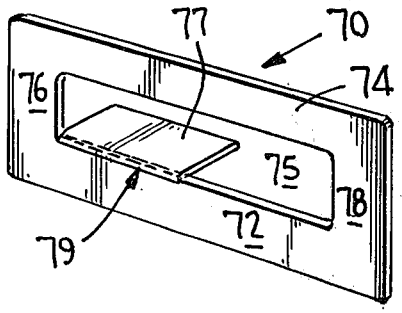
FIG. 5 is a perspective view of the handles which are attached to the containers of FIG. 4.

Handle 70 is illustrated in FIG. 5. It includes first and second side walls 76 and 78, top wall 74 and bottom wall 72. The central portion of the handle is provided with an aperture or slot 75 and an outwardly foldable connecting flap 77 hinged to the upper portion of bottom wall 72 by fold line 79. When attaching this handle to a conventional gable top container, bottom wall 72 is generally aligned so that its upper portion is coextensive with the upper portion of the gable top closure panels. Flap 77 is then folded over the top of the container so that it lays substantially flush against the opposite side of the top closure of the container. It is then either adhered or attached in conventional fashion by fastener 82 to the top of the container. In this manner the faces of handle 70 which are covered with the relatively high shear strength, low tensile strength adhesive can be placed against one another so that they abut over their entire adhesive coated faces.

Any adhesive which has a shear strength sufficient to hold the two containers together when they are being carried, yet is weak enough in tensile strength so that the two containers can be easily pulled apart without a great exertion of force can be utilized. As one example, DC-1117 made by Southern Adhesives Division, Cincinnati, Ohio can be used as an adhesive for covering the handle 1 on the case of the blank having integral handle 60, the adhesive covers both the handle and a portion of panel 56.

From the foregoing description, one skilled in the art can easily ascertain the essential characteristics of the invention and, without departing from the spirit and scope thereof, could make various changes and modifications of the invention to adapt it to various uses and embodiments, e.g., containers other than milk cartons or paperboard containers as described above could be attached by connecting handle portions of such containers.

What is claimed is:

1. A container adapted to facilitate pouring and carrying comprising:
   (a) a bottom wall;
   (b) a plurality of side walls foldably connected to and extending upwardly from said bottom wall;
   (c) a gable top closure foldably connected to and extending upwardly from said side walls, said gable top closure including slanting roof panels, said closure having first and second ends and a pour spout located at one of said ends; and
   (d) a handle assembly connected to and extending upwardly from said top closure, said handle assembly having a first end connected to said closure and a second end extending beyond said closure and one of said side walls, said handle assembly including a handle, said handle having two faces, one of said handle faces being coated with an adhesive which is relatively high in shear strength and relatively low in tensile strength.

2. A container in accordance with claim 1 wherein said first handle assembly end is attached between said two closure ends.

3. A container in accordance with claim 1 wherein said handle assembly includes a generally vertical panel extending upwardly from said gable top.

4. A container in accordance with claim 3 wherein said handle is integral with said vertical panel.

5. A container in accordance with claim 3 wherein said handle is stapled or adhered to said vertical panel.

6. A container in accordance with claim 5 wherein said handle further comprises a central slot and a foldable flap.

7. A pair of detachably connected containers in accordance with claim 1 wherein one end of each of said handle assemblies extends beyond said gable top closure and one of said side walls.

8. A pair of detachably connected containers in accordance with claim 7 wherein each of said handle assemblies extends beyond the second end of said closure.

9. A pair of detachably connected containers in accordance with claim 7 wherein each of said handle assemblies is integrally and foldably connected to said closure.

10. A pair of detachably connected containers in accordance with claim 7 wherein each of said handle assemblies is a separate element attached to said closure by adhesive or staples.

11. A pair of detachably connected containers having a separable handle, each of said containers comprising a bottom wall, a plurality of side walls extending upwardly from said bottom wall, a gable top closure connected to and extending upwardly from said side walls, said gable top closure having first and second ends and a pour spout at said first end, and a handle assembly connected to and extending upwardly from said closure, said handle assembly having two ends and two faces, one of said faces covered by an adhesive, said adhesive being relatively high in shear strength and relatively low in tensile strength, the adhesive faces of said containing being in abutment.

12. A blank for a gable top container comprising:
   (a) first, second, third and fourth foldably connected side walls;

(b) first, second, third and fourth bottom flaps foldably connected to said first, second, third and fourth sidewalls, respectively;

(c) first, second, third and fourth roof panels foldably connected to said first, second, third and fourth side walls, respectively;

(d) first, second, third and fourth primary closure panels foldably connected to said first, second, third and fourth roof panels, respectively;

(e) a first secondary closure panel foldably connected to said first primary closure panel and a second secondary closure panel foldably connected to said third primary closure panel; and (f) a handle attached to one of said secondary closure panels, said handle comprising a first side wall extending upwardly from and generally transverse to said one secondary closure panel, a top handle wall extending from and generally transverse to said first handle side wall and generally parallel to said one secondary closure panel, a second handle side wall extending from and generally transverse to said top handle wall and generally parallel to said first handle side wall and a bottom handle wall extending from and generally transverse to said second handle side wall and generally parallel to said top handle wall, said bottom handle wall being integrally connected to one end of said one secondary closure panel and separated from one of said primary closure panels by a slit.

* * * * *

UNITED STATES PATENT AND TRADEMARK OFFICE

CERTIFICATE OF CORRECTION

PATENT NO. : 4,333,569

DATED : June 8, 1982

INVENTOR(S) : Margaret HAMMACHER

It is certified that error appears in the above-identified patent and that said Letters Patent is hereby corrected as shown below:

Col. 1, line 27, "containers" should be --container--.

Col. 1, line 45, after "containers", insert --,--.

Col. 1, line 58, after "is", insert --to--.

Col. 1, line 68, after "integrally", insert --with--.

Col. 2, line 6, after "is", insert --to--.

Col. 5, line 59, "1 on" should be --. In--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*